US008161924B1

(12) United States Patent
Lockshaw et al.

(10) Patent No.: US 8,161,924 B1
(45) Date of Patent: Apr. 24, 2012

(54) ORBITAL, NON-RECIPROCATING, INTERNAL COMBUSTION ENGINE

(76) Inventors: James Lockshaw, Paso Robles, CA (US); Joseph Gerondale, Paso Robles, CA (US)

( * ) Notice: Subject to any disclaimer, the term of this patent is extended or adjusted under 35 U.S.C. 154(b) by 397 days.

(21) Appl. No.: 12/567,759

(22) Filed: Sep. 26, 2009

Related U.S. Application Data

(63) Continuation-in-part of application No. 11/735,478, filed on Apr. 15, 2007, now Pat. No. 7,721,687.

(60) Provisional application No. 61/100,751, filed on Sep. 28, 2008, provisional application No. 60/792,603, filed on Apr. 17, 2006.

(51) Int. Cl.
*F02B 75/18* (2006.01)

(52) U.S. Cl. ..... 123/52.1; 123/204

(58) Field of Classification Search ..... 123/238, 123/232, 248, 249, 233, 234, 235, 236, 237, 123/204, 52.1; 418/206.1, 103, 13, 146, 418/143–145, 151, 94; 73/259; *F02B 75/18*
See application file for complete search history.

(56) References Cited

U.S. PATENT DOCUMENTS

| | | | | |
|---|---|---|---|---|
| 868,100 | A | 10/1907 | Krehbiel | |
| 1,109,270 | A | 9/1914 | Wallis | |
| 1,215,922 | A | 2/1917 | Fasnacht | |
| 1,705,130 | A | 3/1929 | McKlusky | |
| 1,742,706 | A | 1/1930 | Hermann | |
| 1,817,370 | A * | 8/1931 | Hammerstrom | 123/44 R |
| 2,894,496 | A | 7/1959 | Townsend | |
| 3,043,234 | A | 7/1962 | Poulin | |
| 3,084,562 | A | 4/1963 | Fitzpatrick | |
| 3,105,473 | A | 10/1963 | Johns | |
| 3,353,519 | A | 11/1967 | Reichart | |
| 3,550,565 | A * | 12/1970 | Sanchez | 123/238 |
| 3,942,913 | A | 3/1976 | Bokelman | |
| 4,236,496 | A * | 12/1980 | Brownfield | 123/212 |
| 4,432,314 | A * | 2/1984 | Pelekis | 123/238 |
| 4,530,316 | A | 7/1985 | Morrison | |
| 4,531,481 | A | 7/1985 | Haynes | |
| 4,836,149 | A | 6/1989 | Newbold | |
| 5,343,832 | A | 9/1994 | Murray | |
| 6,457,443 | B1 | 10/2002 | Lillbacka | |
| 6,526,925 | B1 | 3/2003 | Green, Jr. | |
| 6,591,791 | B2 | 7/2003 | DeBei | |

(Continued)

OTHER PUBLICATIONS

U.S. Appl. No. 13/273,587, filed Oct. 14, 2011, Lockshaw et al.

*Primary Examiner* — Noah Kamen
*Assistant Examiner* — Keith Coleman
(74) *Attorney, Agent, or Firm* — Seth D. Levy; Davis Wright Tremaine LLP

(57) ABSTRACT

A combustible fluid operated orbital engine has plural sets of cooperating cylinder and piston members with respective parallel axes of rotation, respective cylinder and piston carrier wheels with respective axes of rotation parallel to the members' axes of rotation carrying said members circularly and orbitally and at all times in opposed relation on a common longitudinal axis along intersecting counter paths. Respective gearing structures supported by the cylinder and piston carrier wheels rotate the members counter to their circular motion direction to maintain their opposed relation for their periodic interfittment when their respective paths intersect. A combustible fluid supply is provided to the cylinder member for combustion coincident with the periodic interfittment in engine operating relation. The common longitudinal axes of the cylinder/piston sets are at all times parallel with each other.

20 Claims, 9 Drawing Sheets

U.S. PATENT DOCUMENTS 6,615,793 B1 9/2003 Usack
6,705,202 B2 3/2004 Harcourt et al.
6,779,433 B2 8/2004 Brosch et al.
7,341,042 B1 * 3/2008 Chung et al. ..... 123/232
7,721,687 B1 5/2010 Lockshaw et al.

* cited by examiner

ORBITAL, NON-RECIPROCATING, INTERNAL COMBUSTION ENGINE

CROSS-REFERENCE TO RELATED APPLICATIONS

This application claims the benefit of U.S. Provisional Application Ser. No. 61/100,751, filed Sep. 28, 2008. This application is further a continuation in part of U.S. patent application Ser. No. 11/735,478 filed Apr. 15, 2007, which application claims the benefit of U.S. Provisional Application Ser. No. 60/792,603 filed Apr. 17, 2006. The disclosures of these applications are hereby incorporated by reference.

BACKGROUND OF THE INVENTION

1. Field of the Invention

The principal object of the present invention is to improve the efficiency of the Otto Cycle internal combustion engine. The Otto Cycle engine, invented in 1861, has served as the preeminent design for the conversion of chemical energy to mechanical energy over many years. There have been many improvements to this ingenious concept but it still exhibits inefficiencies due to friction, torque and pumping losses.

2. Description of the Related Art

The Otto Cycle engine is a reciprocating internal combustion engine. Many of the key work-producing components of the Otto Cycle engine reciprocate, that is they are required to move in a first direction, stop, and then move in a second, opposite direction in order to complete the cycle. In the Otto engine there are four changes of direction of the piston assembly in effecting a single power stroke. Piston assemblies, e.g. pistons, rings, wrist pins and connecting rods, travel up into their respective cylinders at a changing rate of speed to top dead center, i.e. to the end of the stroke, where they stop and then return down the cylinder to the bottom of the stroke. The connecting rod, traveling with the piston and articulating at the wrist pin and orbiting at the crankshaft presents a changing angular force that results in side loading of the piston against the cylinder wall. This causes frictional losses. Because of acceleration and deceleration of the piston components in their movements the internal combustion reciprocating engine requires a flywheel to moderate these energy surges, but this is an imperfect solution and there remain energy consuming effects. The Otto Cycle engine also employs the piston/cylinder relationship to pump air into the cylinder (through reciprocating valves) to support combustion and then to pump the exhaust gases out of the cylinder through reciprocating valves. A significant amount of the engine power is used to achieve the pumping action and two revolutions of the crankshaft are required to effect one power stroke.

BRIEF SUMMARY OF THE INVENTION

The engine design of the present invention, termed the Circle Cycle™ engine, changes some of the basic mechanical principles of the Otto Cycle engine. Instead of a reciprocating motion, the invention engine design employs a non-reciprocating orbital motion of pistons (and cylinders). Thus the invention engine has no engine block, no crankshaft or associated connecting rods, no separate flywheel, intake valves or water pump nor their supporting hardware Instead, in the invention Circle Cycle™ engine pistons and cylinders are each attached to their own respective carrier or drive wheels. By arranging and maintaining the relationship and the position of the piston drive wheel relative to the position of the cylinder drive wheel, an overlap of the piston/cylinder paths can be achieved. This union of the piston and cylinder paths represents the "stroke" of the Circle Cycle™ engine. The piston wheel and the cylinder wheel rotate in opposite directions on their respective (and parallel) axes, and the pistons and cylinders carried thereby are in orbital motion, circling the wheel axes but at the same time counter rotating about their own respective axes to keep, at all times, in position for interfittment, i.e. respective sets of pistons and cooperating cylinders share a common longitudinal axis regardless of their relative positioning on their respective wheels. A working unit, a set comprising a piston and mating cylinder, always stays aligned throughout 360 degrees of wheel rotation. Simply put, a piston always points toward its associated cylinder in the set or unit and the cylinder is pointed open towards its associated piston. There are thus no angular forces (contrast radial piston/cylinder disposition systems where the axial alignment is transitory and local) pushing the piston against the cylinder walls and causing friction. In the Circle Cycle™ engine the stated longitudinal alignment, wherein the cylinder/piston angle is no greater than 0 degrees, enables both compression and combustion forces to be directly in line with piston/cylinder center lines as further explained below. The motion of the cylinders on their carrier wheel and of the pistons on their carrier wheel may be simply illustrated as the motion seen of the seats of a Ferris wheel that are always aligned front facing and with their bottoms pointed towards the ground due to their pivot mounting and the effects of gravity to keep them oriented in the same direction regardless of the Ferris wheel movement.

Like the Ferris wheel illustration, the pistons and cylinders of this invention are always oriented the same way, for interfittment along a common longitudinal axis, avoiding side loading. Unlike the Ferris wheel though, the pistons and cylinders of the invention engine are maintained oriented by gears not gravity to keep them in the desired relative positions.

The Otto Cycle engine has a sliding contact between the piston and the cylinder wall. In the Circle Cycle™ engine the piston only contacts the pressure seal in the base of the cylinder and does not contact the cylinder wall, again saving friction and wear.

Unlike the Otto Cycle engine whose maximum lever arm or torque is achieved when the piston is half-way through its power stroke, the invention engine increases its lever arm through the full distance of the power stroke. The invention engine lever arm is 250% greater than the Otto Cycle engine lever arm; the stroke is 166% longer (as a factor of the typical cylinder bore), and each cylinder completes a power stroke with each, not every other, revolution of the engine, allowing the invention engine to achieve high horsepower at low RPM's, meaning more moderate engine speeds, more work and less friction wear in operating the engine. These mechanical advantages add markedly to fuel efficiency.

Both the cylinder and the piston carrier assemblies act as linked flywheels. All engine components having mass are rotating/orbiting about the wheels' axes of rotation are always in balance. Because pistons and cylinders are orbiting and thus not changing their direction of motion or their velocity (except in relation to engine speed), energy that is lost in Otto Cycle reciprocating engines is conserved in the invention engine.

Other features and advantage of the Circle Cycle™ engine include ease of cooling. In general in the Otto engine cooling is achieved by blowing air across cooling fins on the cylinders or by encasing the cylinders in a water jacket and recirculating water through the jacket and an air cooled radiator; this uses engine energy to pump the water or blow the air. The piston in this arrangement is cooled by heat transfer through the cylinder wall. In the invention engine the piston leaves its cylinder completely after the power stroke, so that both piston and cylinder are exposed to cooling air that has a natural flow in the engine cavity, and minimal engine power is used for cooling.

The Circle Cycle™ engine is in one embodiment operable by a liquid combustible fuel such as gasoline, diesel, biodiesel, etc. wherein an exhaust valve is used to capture exhaust gases for pollution control. In a second embodiment the engine is operable with gaseous combustible fluids such as natural gas, propane, etc. Because these fuels are low in smog producing emissions, as much as 77% less per EPA data, this second embodiment does not require intake or exhaust valves and offers increased engine efficiency and simplicity.

In either of the above and in other embodiments, the basic design provides a capability of variable displacement and variable compression ratios enabling a given engine to be differently "sized" for whatever the current power needs are.

The Circle Cycle™ engine features of lightness and low cost simplicity in construction make it ideal for employment as a electrical generator or power transfer device. Available high strength permanent magnets can be deployed on or in concert with the piston/cylinder carrier wheels without any direct electrical connection between them. Power is then developed through stationary stator coils that are attached to the engine frame or housing and controlled with solid state power management electronics. A single basic Circle Cycle™ engine/generator can thus provide the electrical needs of a house, car, well pump, boat or any other electrically powered device.

With a Circle Cycle™ engine friction, pumping, cooling and even vibration losses are reduced substantially, perhaps as much as 50% with current designs. Add in combustion efficiency and lowered weight and reduced manufacturing costs due to simplicity and inexpensive materials relative to current Otto Cycle engines and it is apparent that the present invention engine is a giant step forward in meeting the Nations' engine modernization needs.

It is an object of the invention to provide an engine as described and method.

This and other objects of the invention to become apparent hereinafter are realized in a combustible fluid operated orbital engine, comprising plural sets of cooperating cylinders and piston members arranged at all times in opposed relation on a common longitudinal axis for circular and orbital motion along intersecting counter paths, gearing structure rotating the members counter to their circular motion to maintain their opposed relation for their periodic interfittment where their respective paths intersect, and a combustible fluid supply to the cylinder member for combustion coincident with their periodic interfittment in engine operating relation, the common longitudinal axes of the sets being at all times parallel with each other.

In a further, more particular embodiment, the invention provides a combustible fluid operated orbital engine, comprising plural sets of cooperating cylinders and piston members having respective parallel axes of rotation, respective cylinder and piston carrier wheels having respective axes of rotation parallel to the members axes of rotation carrying the members circularly and orbitally and at all times in opposed relation on a common longitudinal axis along intersecting counter paths, respective gearing structures supported by the cylinder and piston carrier wheels and rotating the members counter to their circular motion direction to maintain their opposed relation for their periodic interfittment when their respective paths intersect, and a combustible fluid supply to the cylinder member for combustion coincident with the periodic interfittment in engine operating relation, the common longitudinal axes of the sets being at all times parallel with each other.

In this and like embodiments, typically, the cylinder and piston wheels rotate on respective hubs, the hubs having plates defining the wheels, and a hub coupled power take off is also included, each cylinder member has an exhaust port closable during piston entry in combustible fluid compression aiding relation, the cylinder exhaust port is at least partially openable during entry of the piston in combustible fluid compression varying relation, the cylinder exhaust port is open between successive piston entries into the cylinder in coolant passing relation into the cylinder, the engine further includes an exhaust port control valve controlling between the open and closed states of the exhaust port in timed relation with the orbital motion of the cylinder, the cylinder and piston wheels are in opposed edgewise engagement for equal and opposite relative rotation and disposed in the same plane, and a frame supporting the cylinder and piston wheels is also provided, the cylinder and piston wheels rotate on respective hubs, the hubs being supported by the frame and relatively movable in piston stroke within the cylinder varying relation, there is further included a combustible fluid detonator operatively associated with each the cylinder member such as the piston acting to compress the fluid to detonation or a spark plug, and/or the cylinder and piston members counter rotate in a 1:1 ratio to the rotation of their respective carrier wheels.

In its method aspects, the invention contemplates a method of operating a combustible fluid operated orbital engine, including disposing plural sets of cooperating cylinder and piston members at all times in opposed relation on a common longitudinal axis, circularly moving the set members along intersecting counter paths while simultaneously rotating the members counter to their circular motion in orbital relation sufficiently to maintain their disposition on the common longitudinal axis, periodically interfitting the members where their respective paths intersect, and supplying a combustible fluid in the cylinder for detonation responsive to the members interfittment in engine operating relation.

In its further method aspects the invention includes the method of operating a combustible fluid operated orbital engine, including disposing plural sets of cooperating cylinder and piston members having respective parallel axes of rotation at all times in opposed relation on a common longitudinal axis, carrying the members circularly along intersecting counter paths on respective cylinder and piston carrier wheels having axes of rotation parallel to the members axes of rotation while simultaneously rotating the members counter to their circular motion in orbital relation sufficiently to maintain their disposition on the common longitudinal axis, periodically interfitting the members where their respective paths intersect, and supplying a combustible fluid in the cylinder for detonation responsive to the members interfittment in engine operating relation.

In this and like embodiments, typically, the invention method further includes driving rotation of each member with a respective planetary gear carried by a carrier wheel, driving the planetary gears with a common gear rotating with a respective carrier wheel to maintain common longitudinal axis orientation of the members, and peripherally engaging the carrier wheels with each other for equal and opposite relative rotation, also driving a power take off with a the carrier wheel, also maintaining closed within each the cylinder member an exhaust port during piston entry in combustible fluid compression aiding relation, maintaining the cylinder exhaust port at least partially open during entry of the piston in combustible fluid compression varying relation, varying the spacing between the cylinder and piston carrier wheels in piston stroke limiting relation, and or also counter rotating the cylinder and piston members in a 1:1 ratio to the rotation of their respective carrier wheels.

BRIEF DESCRIPTION OF THE SEVERAL VIEWS OF THE DRAWINGS

The invention will be further described in conjunction with the attached drawings in which.

DETAILED DESCRIPTION OF THE PREFERRED EMBODIMENTS

Figure 1:
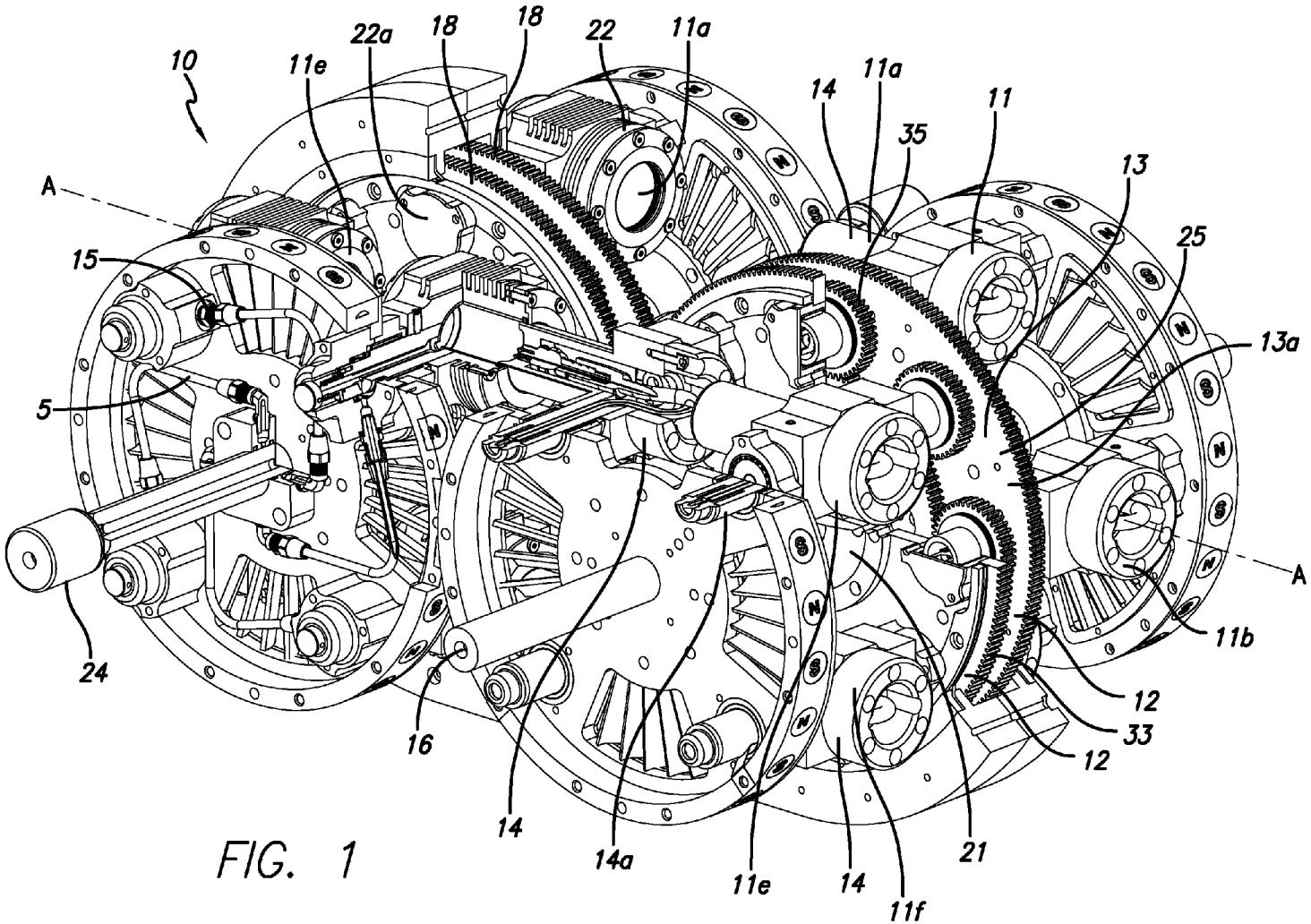
FIG. 1 is an oblique fragmentary view of an engine according to the invention in an 8 cylinder embodiment having two banks of four cylinder/piston sets.
Figure 2:
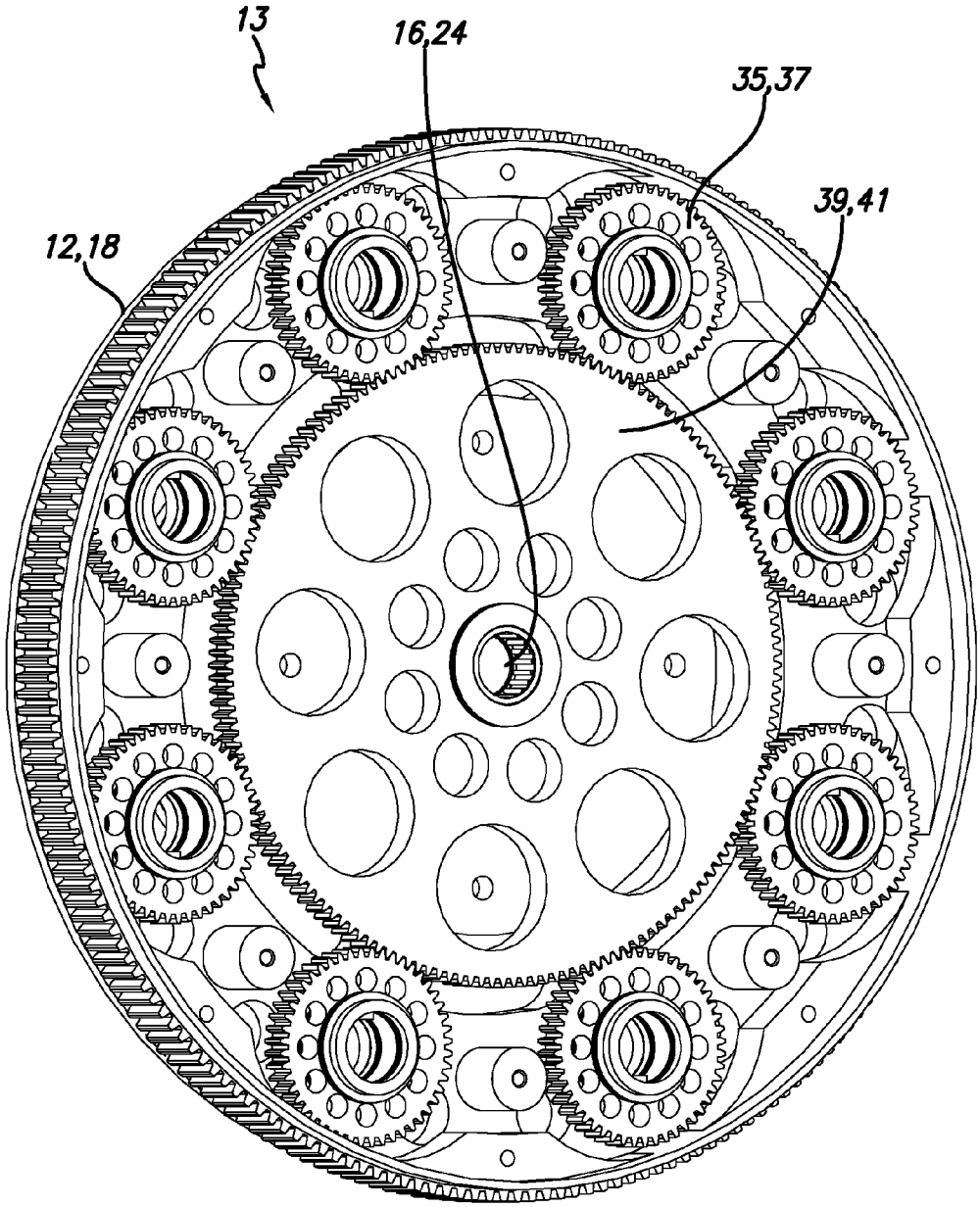
FIG. 2 is a view of a carrier wheel as used in the embodiment of FIG. 1.
Figure 3:
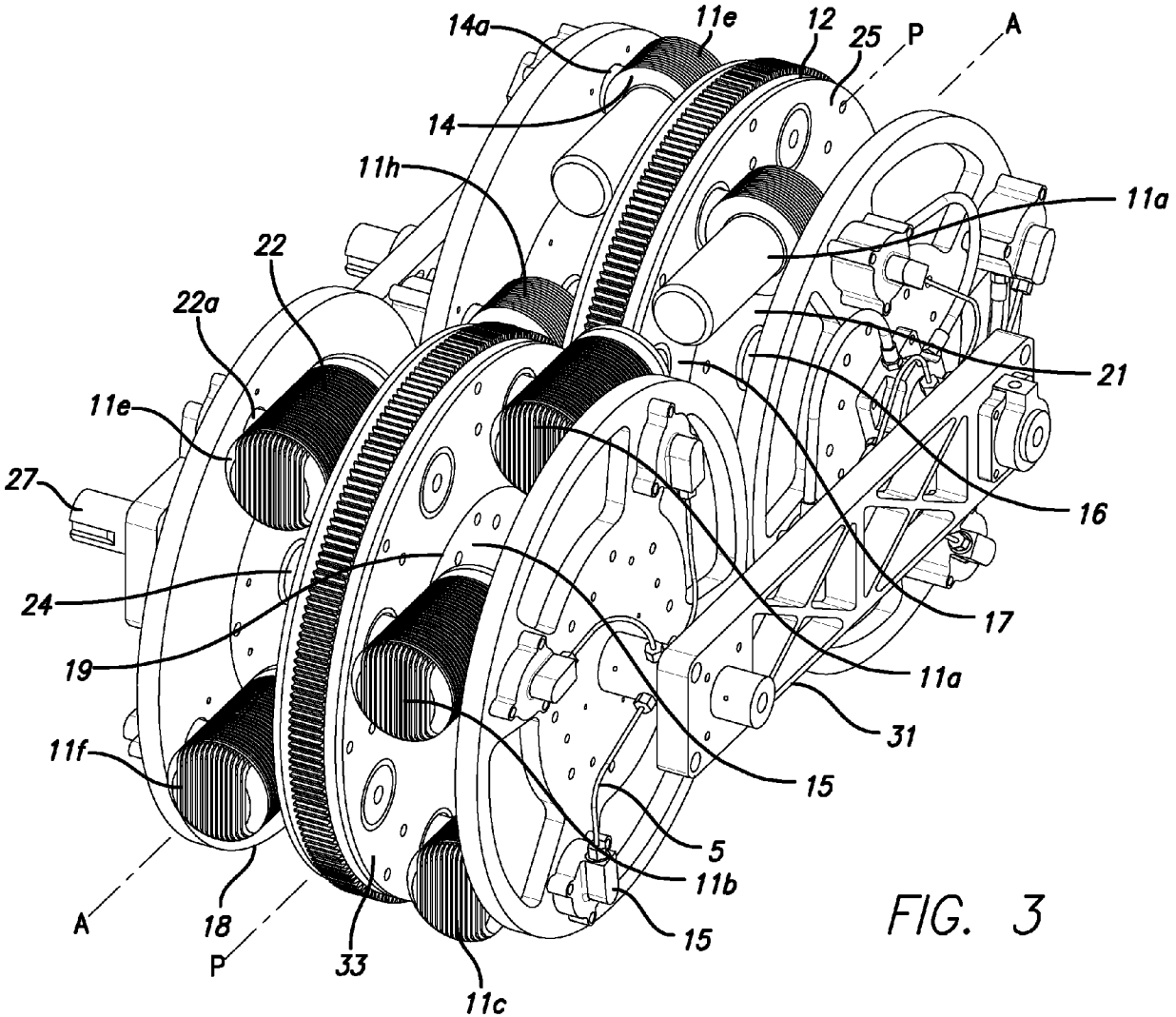
FIG. 3 is an oblique fragmentary view of an engine according to the invention in a further embodiment.
Figure 4:
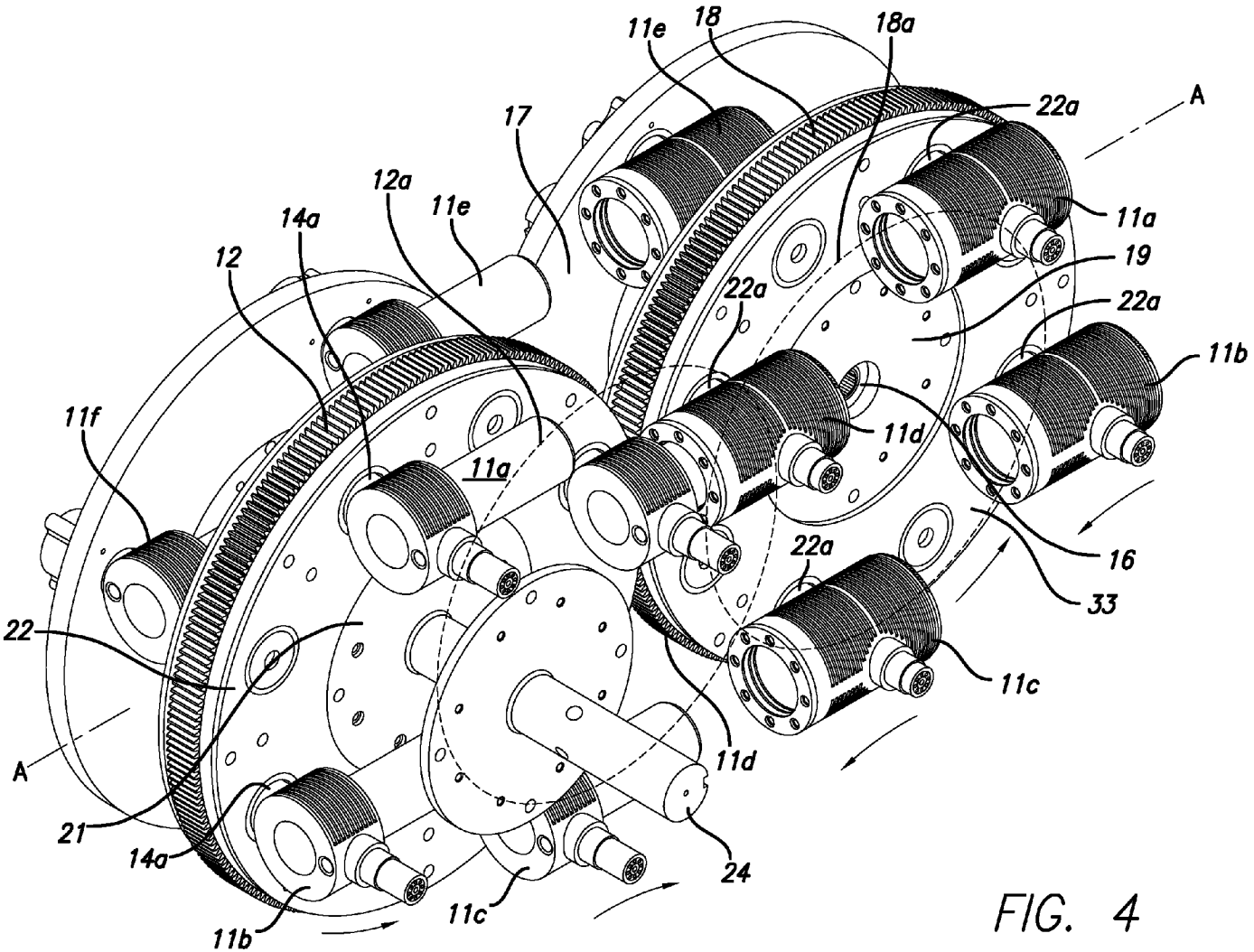
FIG. 4 is a further fragmentary view of the embodiment of FIG. 3, additional parts having been removed.
Figure 5:
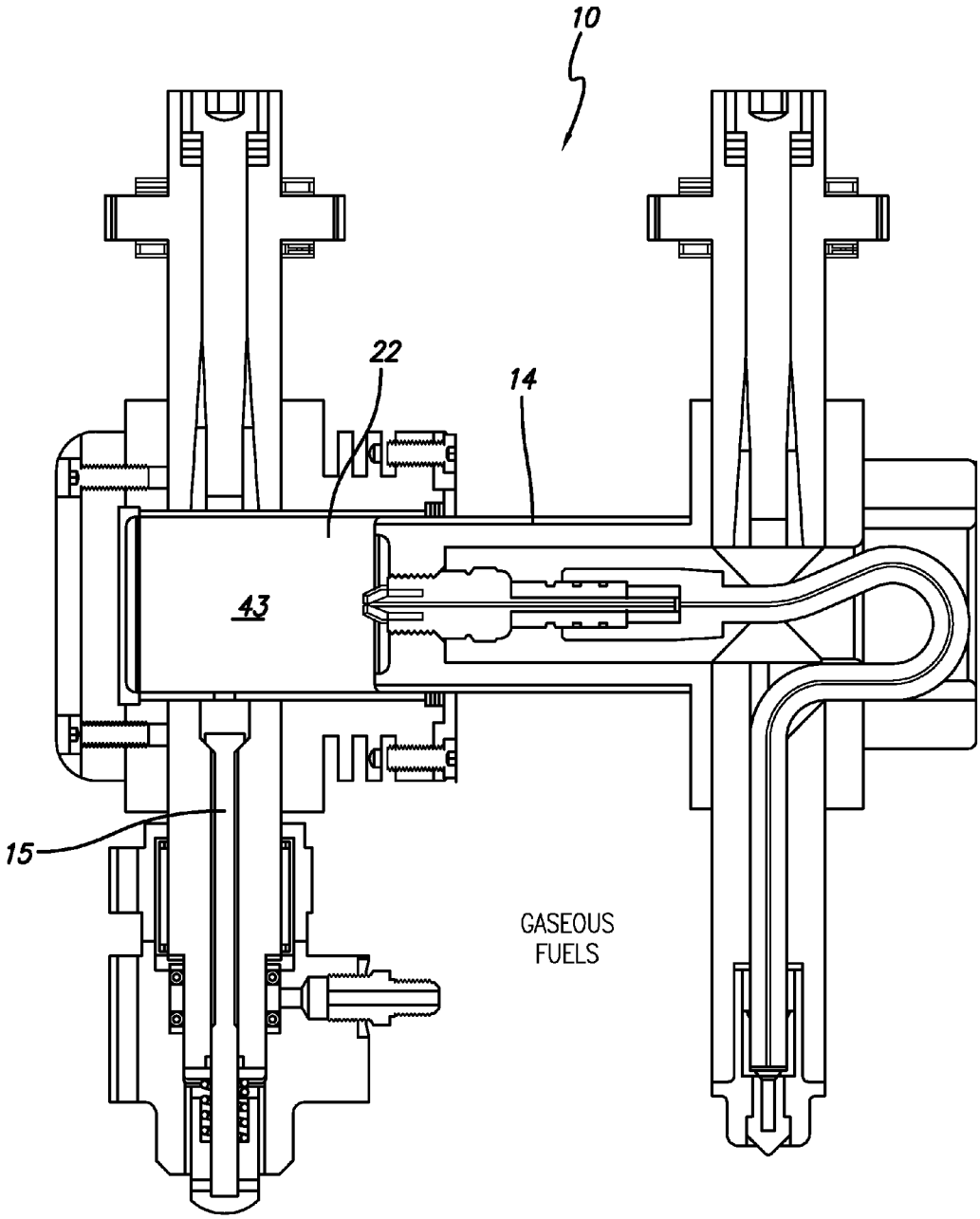
FIG. 5 is a detail side elevation view of a piston cylinder set and associated components in a liquid fuel embodiment of the invention.

With reference now to the drawings in detail, and particularly FIGS. 1-7, a combustible fluid operated orbital engine is shown at 10 comprising plural sets 11 of cooperating cylinder members 22 and piston members 14 arranged at all times in opposed relation on a common longitudinal axis A-A for orbital motion along intersecting counter paths 18*a*, 12*a* defined by respective cylinder and piston carrier or drive wheels 12, 18. A gearing structure 13 also carried by the carrier wheels 12, 18 and best shown in FIGS. 1 and 2 serves to rotate the cylinder and piston members 22, 14 counter to their circular motion along paths 18*a*, 12*a* whereby their common longitudinal axis A-A relation is maintained despite the wheels circular travel. That is, cylinder and piston members 22, 14 are being carried circularly on their respective carrier wheels 12, 18, See FIG. 7, about axles 24, 16, respectively, but gearing structure 13 acts to rotate the cylinders and piston members about their respective axes defined by their respective axles 22*a*, 14*a* as they are carried circularly. The motion of the cylinder and piston members 22, 14 is both circular with wheels 18, 12 and simultaneously rotational about their own respective axes on axles 22*a*, 14*a*, and thus orbital.

Figure 7:
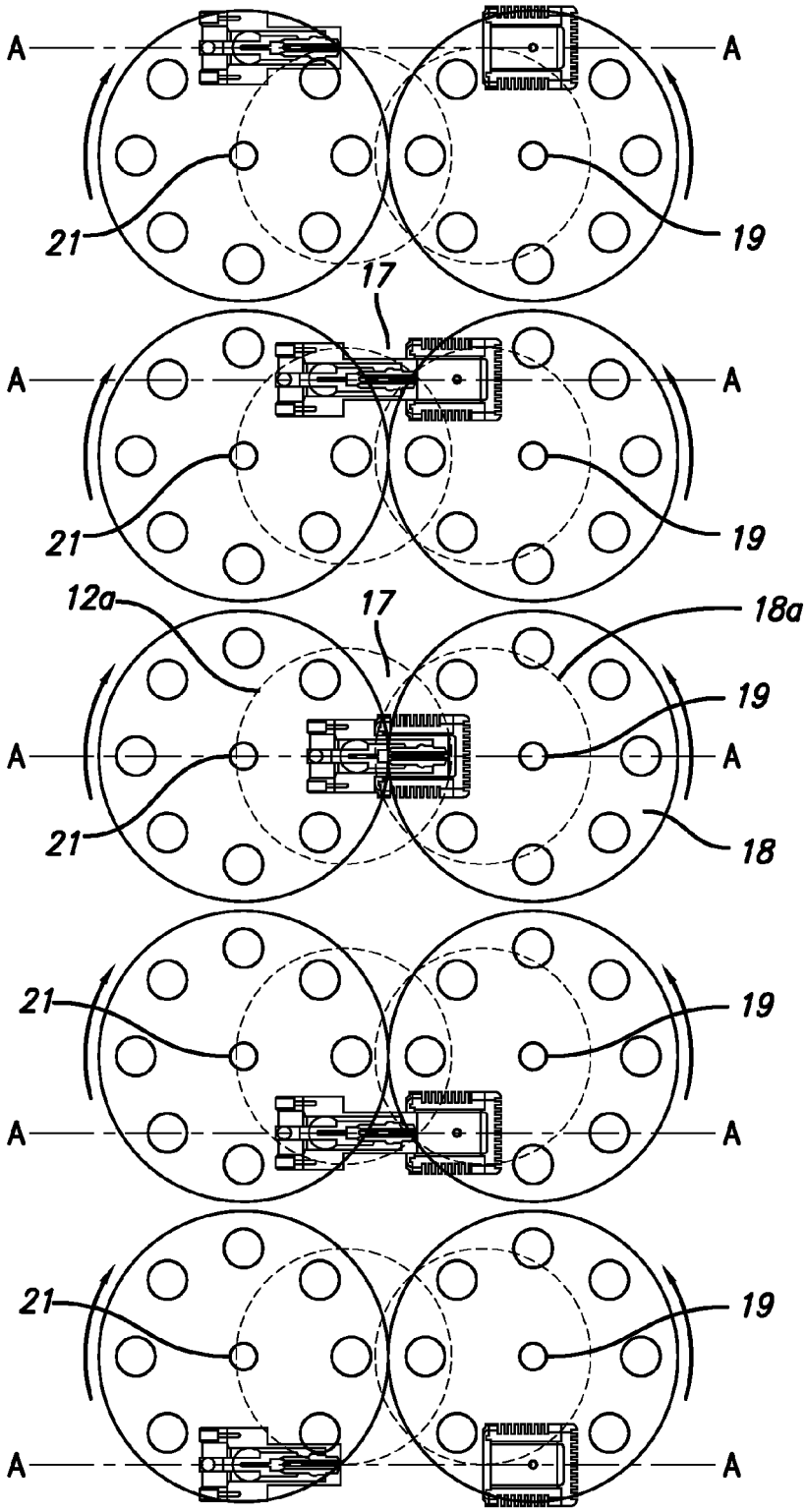
FIG. 7 is a schematic view of the arrangement of a piston cylinder set through respective 360 degree paths.
Figure 8:
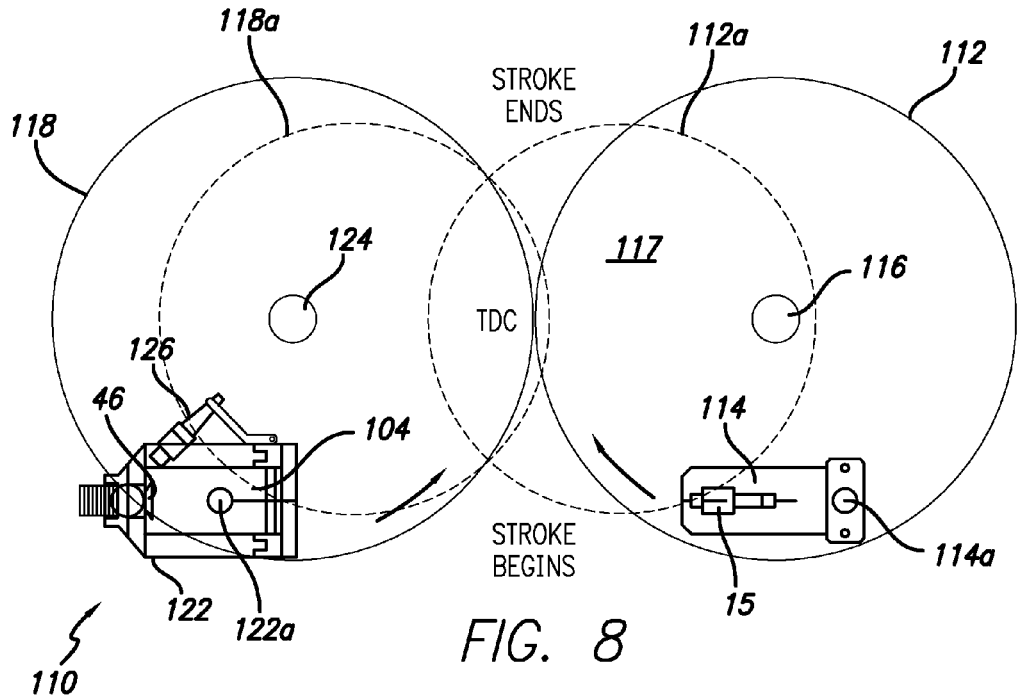
FIGS. 8 to 11 are progressive schematic depictions of a side elevation view of the engine with the piston and cylinder approaching, interfitting and withdrawing as a result of their travel paths as defined by their respective carrier wheels.
Figure 9:
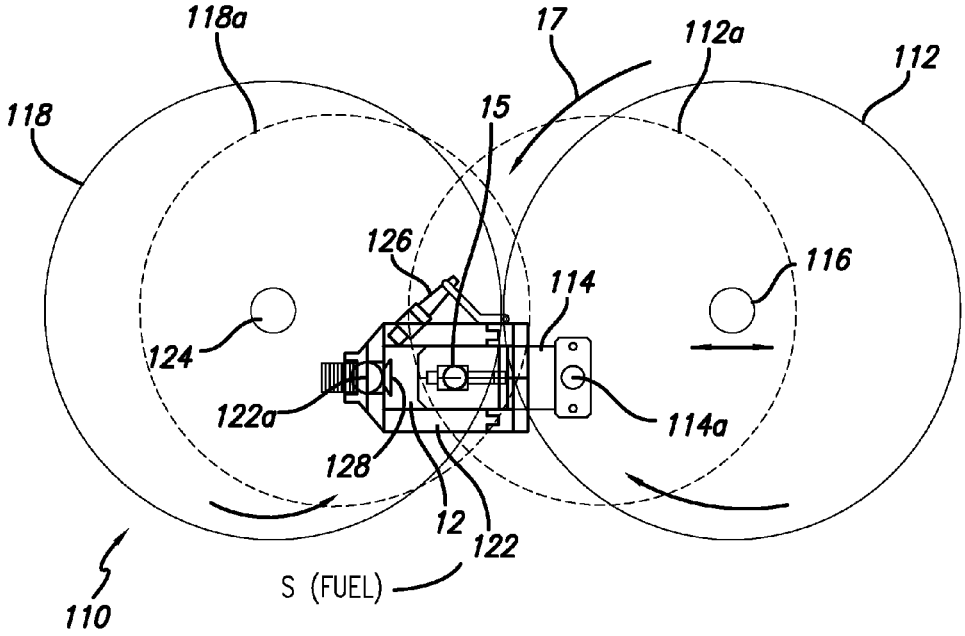
Figure 10:
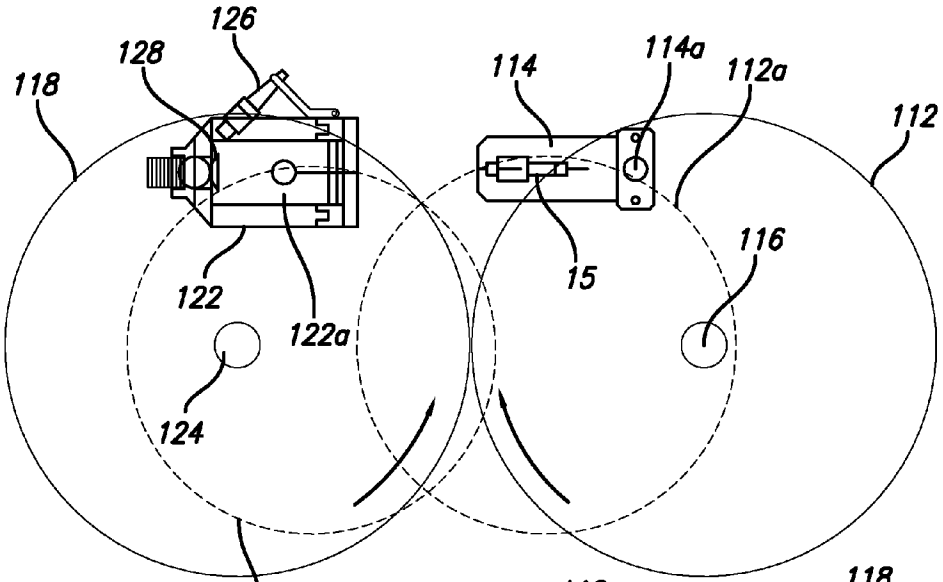
Figure 11:
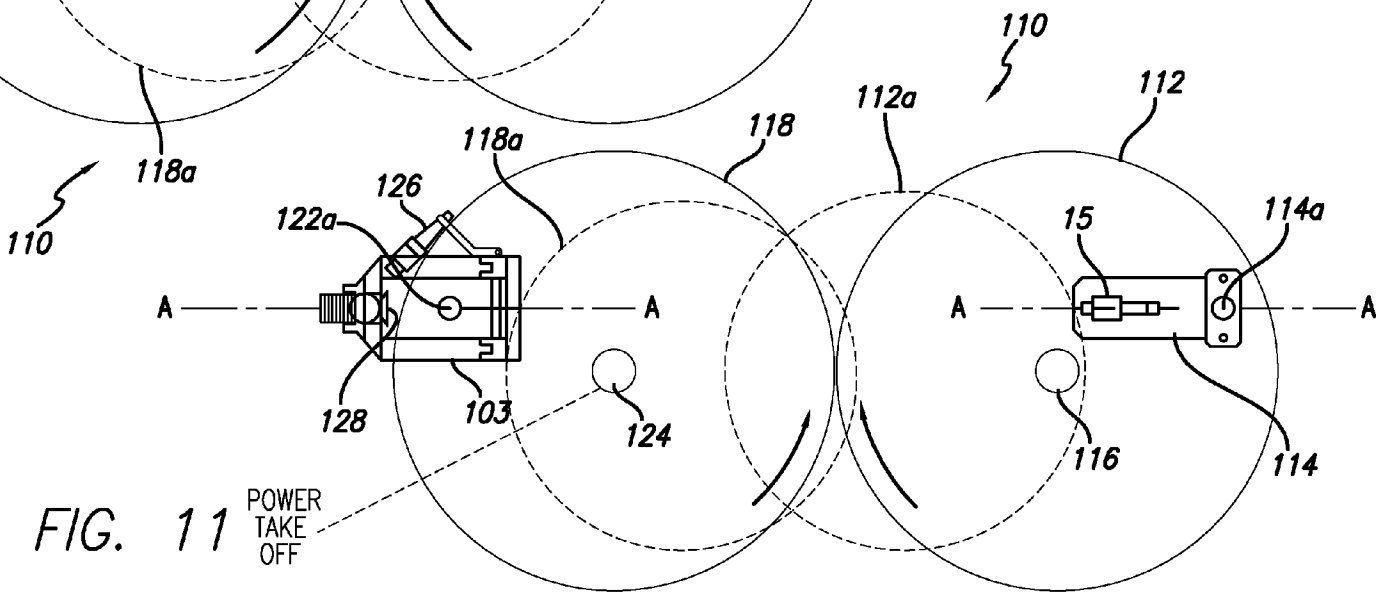

Gearing 13 maintains the opposed relation of the cylinder and piston members 22, 14 for their periodic interfittment where their respective paths 18*a*, 12*a* intersect, See FIG. 7. There is a combustible fluid supply S to the cylinder member 22, via injectors 15, via the piston members 14, or otherwise, for combustion coincident with the periodic interfittment of the cylinder and piston members in engine 10 operating relation.

It will be noted that the common longitudinal axes A-A, of the respective sets 11 are at all times parallel with each other, and that the arrangement of the set members 14, 22 is always at no more than 0 degrees and never angled near their locus of interfittment 17.

More particularly, the invention provides the combustible fluid operated orbital engine 10, comprising plural sets 11*a*, 11*b* . . . 11*h* of cooperating cylinder and piston members 22, 14 having respective parallel axes of rotation defined by their axles 24, 16. Respective cylinder and piston carrier wheels 18, 12 have respective axes of rotation defined by their axles 22*a*, 14*a* parallel to the members' transverse axes of rotation on axles 22*a*,14*a* to carry the members 22, 14 orbitally, as described above, and at all times in opposed relation on a common longitudinal axis A-A along intersecting counter paths 18*a*, 12*a*. Gearing structure 13 supported by the cylinder and piston carrier wheels 18, 12 rotates the members 22, 14 counter to their circular motion direction as shown in FIG. 7 to maintain their opposed relation for their periodic interfittment at locus 17 when their respective paths 18*a*, 12*a* intersect. Combustible fluid supply S is to the cylinder member 22 for combustion coincident with the periodic interfittment in engine 10 operating relation. Again, the common longitudinal axes A-A of the sets 11*a*, etc., are at all times parallel with each other.

Figure 6:
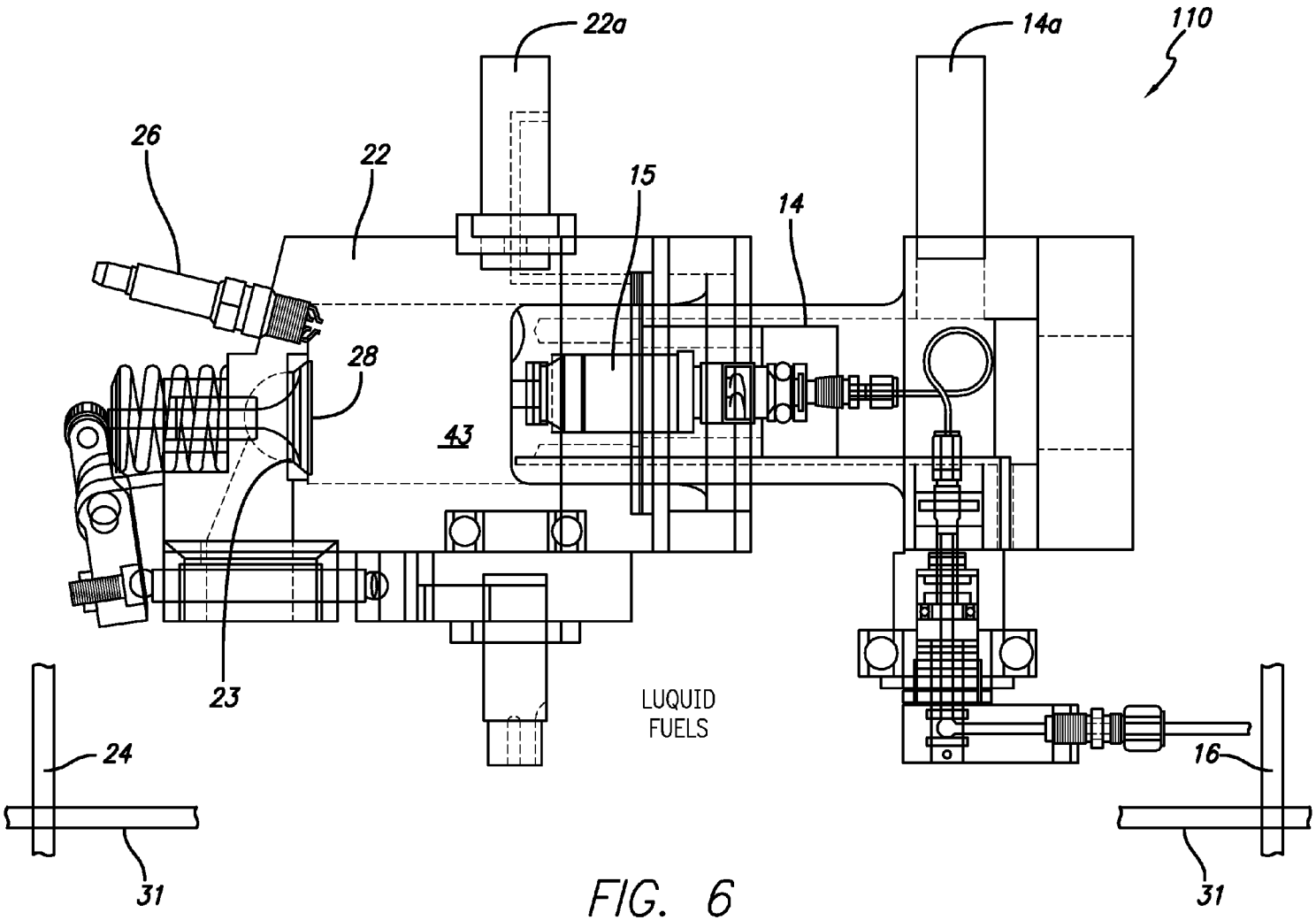
FIG. 6 is a detail side elevation view of a piston cylinder set and associated components in a gaseous fuel embodiment of the invention.

The cylinder and piston wheels 18, 12 rotate on respective hubs 19, 21. Hubs 19, 21 have plates 33, 25 defining the wheels 18, 12 and a hub-coupled power take off shaft 27 if needed. As best seen in FIG. 6, each cylinder member 22 has an exhaust port 23 closable during piston 14 entry in combustible fluid compression aiding relation. The cylinder exhaust port 23 can be at least partially openable during entry of the piston 14 to allow loss of fluid in combustible fluid compression varying relation. Cylinder exhaust port 23 is open between successive piston 14 entries into the cylinder 22 in coolant passing relation into the cylinder. Engine 10 further includes an exhaust port control valve 28 controlling between the open and closed states of the exhaust port 23 in timed relation with the orbital motion of the cylinder 22.

The cylinder and piston wheels 22, 18 are shown in opposed edgewise engagement for equal and opposite relative rotation and disposed in the same plane P-P. Frame member 31, shown in part schematically in FIG. 3 to illustrate its variable length for shifting wheels 22, 18 closer or farther apart supports the cylinder and piston wheels 22, 18 to vary piston 14 insertion into cylinder 22 as set out hereinafter.

Thus, the cylinder and piston wheels 22, 18 rotate on respective hubs 19, 21, the hubs being supported by the frame 31 to be relatively movable to and from one another in piston stroke within the cylinder varying relation, enabling power output variation to be simply realized. A combustible fluid detonator comprising spark plug 26 is operatively associated with each the cylinder member 22 such as the piston 14 acting to compress the fluid (a diesel embodiment) to detonation or the spark plug shown.

Because the cylinders and pistons 22, 14 are to remain on a common longitudinal axis A-A, they need to be turned on their transverse axes, i.e. rotated and counter to the circular direction of movement to remain aligned within their set 11 throughout 360 degrees of travel as they are carried circularly by the wheels 12, 18. Note the respective arrows in the Figures. The ratio the counter rotation of cylinder and piston members 22, 14 counter rotation to the circular carriage rotation of their respective carrier wheels is whatever is needed to maintain within a set 11 the axial alignment on the common longitudinal axis A-A. Typically this will be 1:1 in most embodiments.

The invention method of operating a combustible fluid operated orbital engine 10, includes disposing plural sets 11 of cooperating cylinder and piston members 22, 14 at all times in opposed relation on the common longitudinal axis A-A, circularly moving the set members along intersecting counter paths 12*a*, 18*a* while simultaneously rotating the members about their own axes 22*a*, 14*a* counter to their circular motion in orbital relation sufficiently to maintain their disposition on the common longitudinal axis, periodically interfitting the members where their respective paths intersect, and supplying a combustible fluid in the cylinder for detonation responsive to the members interfittment in engine operating relation.

More particularly, the invention method of operating a combustible fluid operated orbital engine includes disposing plural sets 11 of cooperating cylinder and piston members 22, 14 having respective parallel axes of rotation 22*a*, 14*a* at all times in opposed relation on a common longitudinal axis A-A, carrying the members circularly along intersecting counter paths 18*a*, 12*a* on respective cylinder and piston carrier wheels 18, 12 having axes of rotation 24, 16 parallel to the members' axes of rotation while simultaneously rotating the members counter to their circular motion in orbital relation sufficiently to maintain their disposition on the common longitudinal axis, periodically interfitting the members where their respective paths intersect, and supplying a combustible fluid in the cylinder for detonation responsive to the members interfittment in engine operating relation.

The invention method further includes driving rotation of each member 22, 14 with a respective planetary gear 35, 37 carried by a carrier wheel 22, 18, driving the planetary gears with a common gear 39, 41 rotating with a respective carrier wheel to maintain common longitudinal axis A-A orientation of the members, and peripherally engaging the carrier wheels with each other at locus of engagement 17 for equal and opposite relative rotation, driving a power take off shaft 27 with a carrier wheel 22 or 18, maintaining closed within each the cylinder member an exhaust port 23 during piston entry in combustible fluid compression aiding relation, maintaining the cylinder exhaust port at least partially open during entry of the piston in combustible fluid compression varying relation, varying the minimum spacing 43 between the cylinder and piston carrier wheels in piston stroke limiting relation, and/or also counter rotating the cylinder and piston members in a 1:1 ratio to the rotation of their respective carrier wheels.

The basic movement of the pistons 114 and cylinders 122 of engine 110 is schematically illustrated in FIGS. 7 and 8-11. There an illustrative piston carrier wheel 112 carries piston 114 rotating clockwise (CW) on a circular path 112*a* about an axle 116. An illustrative cylinder carrier wheel 118 carrying cylinder 122 is shown rotating counter clockwise (COW) on a circular path 118*a* about axle 124 that is parallel with axle 116. Path 118*a* intersects path 112*a* as shown. Piston 114 and the cylinder 122 are disposed chordally to the paths 112*a* and 118*a* except in the minor case of including the geometric center of the paths. Being thus carried the piston 114 and cylinder 122 are in alignment as they approach each other and as they depart each other as shown. Fuel supply S to the cylinder 122 is via the piston 114 during the interfitting stroke and detonation is effected by spark plug 126 such that the piston is driven backward from interfittment, with the reaction force driving the cylinder carrier wheel 118 counterclockwise to power a take off gear train. The carrier wheels 112, 118, then rotate under the explosive impetus of this first detonation to bring a further cylinder 122 and a further piston 114 together in a circle cycle. Further structural details are shown in FIGS. 1-6.

Control of the sole exhaust valve 128 in each cylinder 122 includes closing the valve when the piston 114 enters the cylinder 122 for full horsepower output, fuel is injected during the compression cycle, spark plug 126 ignites the fuel, exhaust valve 128 opens to vent the exhaust gases before the piston 114 leaves the cylinder 122. The exhaust valve 126 then remains open through the rest of the rotation allowing fresh air to enter and cool and replenish air in the cylinder 122. With lower horse power requirements the exhaust valve 126 can be adjustably cammed open until the piston 114 has traveled less than the full stroke into cylinder 122, e.g. as much as ⅔ the length of the cylinder, and then close, effectively reducing the volume of air to be found in the cylinder. Concurrently the piston and cylinder wheels 112, 118 are moved closer together (by a small amount) to reduce the volume of the combustion chamber proportionately to the reduced air volume to thereby maintain the original compression ratio. This feature enables changing the horsepower output while maintaining the same basic movement of components to vary power output to the task's horsepower requirements, wasting less energy and greatly improving efficiency.

ADVANTAGES

It will be noted that the circle cycle engine of the invention features an absence of reciprocating action of the pistons and piston rods; this eliminates the inertial losses associated with reciprocation.

Pistons and cylinders are in constant orbital motion.

Pistons and cylinders are in direct alignment throughout the compression and power cycle eliminating connecting rod angular oscillation; this minimizes frictional losses between pistons and cylinders.

Greater lever arm advantage inherent in the circle cycle engine results in higher torsional forces allowing for low RPM operation and less engine wear.

The circle cycle engine has no crankshaft, no block, no connecting rods and no wrist pins to complicate the engine.

No piston rings—sealing and oiling is achieved at the bottom of the cylinder by nonmetallic materials and this results in less wear on pistons and cylinders.

No separate flywheel. Flywheel inertia is inherent in the use of carrier wheels in this engine design.

Only one valve per cylinder, and thus less supporting hardware.

Air cooled from inside and outside of cylinders and pistons eliminating radiator, water pumps, hoses, etc.

All cylinders complete a power stroke with each revolution.

Variable compression pressures allow ready or automatic adjustment for different fuels and greatly increase the efficiency of combustion, reducing pollution, eliminating engine knock and allowing for the use of available fuel including synfuels and biofuels.

Automatic variable exhaust valve control allows changes in displacement of the engine to effectively control engine horsepower to the level needed. This reduces the number of transmission gears required on vehicles and improves engine efficiency.

Direct injection of the fuel into the cylinder, e.g. through the piston, providing optimum air/fuel mixing and increased combustion efficiency.

The circle cycle engine is suitable for diesel operation by increasing compression and injector pressure, as well as for operation by steam, compressed gas, or other fluid energy source.

We claim:

1. A combustible fluid operated orbital engine, comprising plural sets of cooperating cylinders and piston members arranged at all times in opposed relation on a common longitudinal axis for circular and orbital motion along intersecting counter paths, gearing structure rotating said members counter to their said orbital motion to maintain their said opposed relation for their periodic interfittment where their respective paths intersect, and a combustible fluid supply to said cylinder member for combustion coincident with their said periodic interfittment in engine operating relation, said common longitudinal axes of said sets being at all times parallel with each other.

2. A combustible fluid operated orbital engine, comprising plural sets of cooperating cylinder and piston members having respective parallel axes of rotation, respective cylinder and piston carrier wheels having respective axes of rotation parallel to said members axes of rotation carrying said members circularly and orbitally and at all times in opposed relation on a common longitudinal axis along intersecting counter paths, respective gearing structures supported by said cylinder and piston carrier wheels and rotating said members counter to their said circular motion direction to maintain their said opposed relation for their periodic interfittment when their respective paths intersect, and a combustible fluid supply to said cylinder member for combustion coincident with said periodic interfittment in engine operating relation, said common longitudinal axes of said sets being at all times parallel with each other.

3. The combustible fluid operated orbital engine according to claim 2, in which said cylinder and piston wheels rotate on respective hubs, said hubs having plates defining said wheels, and including also a hub coupled power take off.

4. A combustible fluid operated orbital engine according to claim 2, in which each said cylinder member has an exhaust port closable during piston entry in combustible fluid compression aiding relation.

5. The combustible fluid operate engine according to claim 4, in which said cylinder exhaust port is at least partially openable during entry of said piston in combustible fluid compression varying relation.

6. The combustible fluid operated engine according to claim 4, in which said cylinder exhaust port is open between successive piston entries into said cylinder in coolant passing relation into said cylinder.

7. The combustible fluid operated engine according to claim 6, in which said engine further includes an exhaust port control valve controlling between the open and closed states of said exhaust port in timed relation with said orbital motion of said cylinder.

8. The combustible fluid operated orbital engine according to claim 2, in which said cylinder and piston wheels are in opposed edgewise engagement for equal and opposite relative rotation and disposed in the same plane, and including also a frame supporting said cylinder and piston wheels.

9. The combustible fluid operated orbital engine according to claim 8, in which said cylinder and piston wheels rotate on respective hubs, said hubs being supported by said frame and relatively movable in piston stroke within said cylinder varying relation.

10. The combustible fluid operated orbital engine according to claim 2, including also a combustible fluid detonator operatively associated with each said cylinder member.

11. The combustible fluid operated orbital engine according to claim 10, in which said combustible fluid detonator comprises a spark plug.

12. The combustible fluid operated orbital engine according to claim 2, in which said cylinder and piston members counter rotate in a 1:1 ratio to the rotation of their respective carrier wheels.

13. A method of operating a combustible fluid operated orbital engine, including disposing plural sets of cooperating cylinder and piston members at all times in opposed relation on a common longitudinal axis, circularly moving said set members along intersecting counter paths while simultaneously rotating said members counter to their said circular motion in orbital relation sufficiently to maintain their said disposition on said common longitudinal axis, periodically interfitting said members where their respective paths intersect, and supplying a combustible fluid in said cylinder for detonation responsive to said members interfittment in engine operating relation.

14. A method of operating a combustible fluid operated orbital engine, including disposing plural sets of cooperating cylinder and piston members having respective parallel axes of rotation at all times in opposed relation on a common longitudinal axis, carrying said members circularly along intersecting counter paths on respective cylinder and piston carrier wheels having axes of rotation parallel to said members axes of rotation while simultaneously rotating said members counter to their said circular motion in orbital relation sufficiently to maintain their said disposition on said common longitudinal axis, periodically interfitting said members where their respective paths intersect, and supplying a combustible fluid in said cylinder for detonation responsive to said members interfittment in engine operating relation.

15. The method according to claim 14, including also driving rotation of each said member with a respective planetary gear carried by a said carrier wheel, driving said planetary gears with a common gear rotating with a respective said carrier wheel to maintain common longitudinal axis orientation of said members, and peripherally engaging said carrier wheels with each other for equal and opposite relative rotation.

16. The method according to claim 15, including also driving a power take off with a said carrier wheel.

17. The method according to claim 15, including also maintaining closed within each said cylinder member an exhaust port during piston entry in combustible fluid compression aiding relation.

18. The method according to claim 17, including also maintaining said cylinder exhaust port at least partially open during entry of said piston in combustible fluid compression varying relation.

19. The method according to claim 18, including also varying the spacing between said cylinder and piston carrier wheels in piston stroke limiting relation.

20. The method according to claim 15, including also counter rotating said cylinder and piston members in a 1:1 ratio to the rotation of their respective carrier wheels.

* * * * *